US007354352B2

(12) United States Patent
Keska et al.

(10) Patent No.: US 7,354,352 B2
(45) Date of Patent: Apr. 8, 2008

(54) MOTORIZED DRIVE FOR JUVENILE SWING

(76) Inventors: Tadeusz W. Keska, 175 Old Country Rd., Smithfield, RI (US) 02917; Mark S. Duffy, 216 Summer St., Arlington, MA (US) 02474; Christopher C. Briden, 202 Colvintown Rd., Coventry, RI (US) 02864; Chinawut P. Paesang, 236 Curran Rd., Cumberland, RI (US) 02864

( * ) Notice: Subject to any disclaimer, the term of this patent is extended or adjusted under 35 U.S.C. 154(b) by 305 days.

(21) Appl. No.: 11/091,118

(22) Filed: Mar. 28, 2005
(Under 37 CFR 1.47)

(65) Prior Publication Data

US 2006/0019760 A1 Jan. 26, 2006

Related U.S. Application Data

(63) Continuation-in-part of application No. 10/427,363, filed on May 1, 2003, now Pat. No. 6,872,146.

(51) Int. Cl.
*A63G 9/16* (2006.01)

(52) U.S. Cl. ..... 472/119; 5/108

(58) Field of Classification Search ..... 472/118–125; 5/108–109

See application file for complete search history.

(56) References Cited

U.S. PATENT DOCUMENTS

| | | | |
|---|---|---|---|
| 3,842,450 | A | 10/1974 | Pad |
| 4,150,820 | A | 4/1979 | Bochmann |
| 4,448,410 | A | 5/1984 | Kosoff |
| 4,452,446 | A | 6/1984 | Saint |
| 4,491,317 | A | 1/1985 | Bansal |
| 4,616,824 | A | 10/1986 | Quinlan, Jr. et al. |
| 4,722,521 | A | 2/1988 | Hyde et al. |
| 4,785,678 | A | 11/1988 | McGugan et al. |
| 4,911,429 | A | 3/1990 | Ogbu |
| 5,139,462 | A | 8/1992 | Gabe |
| 5,326,327 | A | 7/1994 | Stephens et al. |
| 5,376,053 | A | 12/1994 | Ponder et al. |
| 5,525,113 | A | 6/1996 | Mitchell et al. |
| 5,769,727 | A | 6/1998 | Fair et al. |
| 5,833,545 | A | 11/1998 | Pinch et al. |
| 5,846,136 | A | 12/1998 | Wu |
| 5,975,631 | A | 11/1999 | Fair et al. |
| 5,984,791 | A | 11/1999 | Fair et al. |
| 6,022,277 | A | 2/2000 | Jankowski |
| 6,059,667 | A | 5/2000 | Pinch |
| 6,068,566 | A | 5/2000 | Kim |
| 6,319,138 | B1 | 11/2001 | Fair et al. |
| 6,339,304 | B1 | 1/2002 | Allison et al. |
| 6,386,986 | B1 | 5/2002 | Sonner et al. |
| 6,421,901 | B2 | 7/2002 | Sitarski et al. |
| 6,471,597 | B1 | 10/2002 | Flannery et al. |

(Continued)

*Primary Examiner*—Kien Nguyen
(74) *Attorney, Agent, or Firm*—Barnes & Thornburg LLP

(57) ABSTRACT

A swing apparatus comprises a support stand, a swing supported with respect to the support stand to oscillate back and forth along a swing arc about a pivot axis, and a drive assembly that operates to oscillate the swing. Various components of the drive assembly are coupled to the swing to oscillate therewith about the pivot axis. The drive assembly has a pair of drive members that periodically engage portions of the support stand resulting in forces being imparted on the swing to move the swing.

31 Claims, 7 Drawing Sheets

U.S. PATENT DOCUMENTS 6,500,072 B1 * 12/2002 Myers et al. ..... 472/119
6,511,123 B1 1/2003 Sitarski et al.
6,544,128 B1 4/2003 Yang
6,561,915 B2 5/2003 Kelly et al.
6,626,766 B1 9/2003 Hsia
6,692,368 B1 2/2004 Hyun
6,824,473 B2 11/2004 Wu
6,875,117 B2 4/2005 Ransil et al.
6,916,249 B2 7/2005 Meade
2002/0052245 A1 5/2002 Flannery et al.
2003/0069079 A1 4/2003 Kelly et al.
2003/0181249 A1 9/2003 Meade
2004/0102253 A1 5/2004 Ransil et al.

* cited by examiner

MOTORIZED DRIVE FOR JUVENILE SWING

This patent application is a continuation-in-part of U.S. patent application Ser. No. 10/427,363 which was filed May 1, 2003 now U.S. Pat. No. 6,872,146 and which is hereby incorporated by reference herein.

BACKGROUND

The present disclosure relates to juvenile swings, and particularly, to a juvenile swing apparatus having a motorized drive assembly. More particularly, the present disclosure relates to a juvenile swing apparatus having a motorized drive assembly that operates to oscillate a seat of the apparatus back and forth along a swing arc.

A conventional juvenile swing apparatus typically has a seat suspended from a floor-supported stand by one or more hanger arms. These conventional juvenile swing assemblies usually comprise some sort of drive mechanism to move the seat and hanger arms back and forth along a swing arc in an oscillatory manner. Juvenile swings sometimes comprise a lost-motion connection between the drive mechanism and the hanger arm so that, if the hanger arm and seat are prevented from swinging, either intentionally or unintentionally, the drive mechanism can continue to operate without damaging components of the juvenile swing. Motorized swings that are powered, in some instances by batteries, have become more popular in recent times. These motorized swings sometimes have motors with adjustable speeds to permit a user to change the frequency of the swinging motion of the seat.

SUMMARY

According to the present disclosure, a swing apparatus comprises a support stand, a swing supported with respect to the support stand to oscillate back and forth along a swing arc, and a drive assembly that operates to oscillate the swing relative to the support stand. The drive assembly has a driver mounted to the hanger arm to oscillate therewith. The drive assembly also has drive members that are driven by the driver and that periodically engage portions of the support stand resulting in a force being imparted on the hanger arm to move the swing.

In an illustrative embodiment, the support stand comprises a set of frame members and a pair of housings coupled to the upper ends of associated frame members. The drive assembly is situated in an interior region of one of the housings. The illustrative hanger arm that is driven by the drive assembly has a mounting portion to which an electric motor of the drive assembly is coupled. The mounting portion, along with the rest of the hanger arm and the motor, oscillates about a pivot axis during operation of the swing assembly. The illustrative drive assembly further includes a drive train that transmits motion from the driver to the drive members. In the illustrative embodiment, the drive train comprises a worm mounted on an output shaft of the motor, a worm wheel rotatably coupled to the mounting portion of the hanger arm and meshed with the worm, a pivot link that pivots about the same pivot axis that the hanger arm pivots about, and a connector link that interconnects the worm wheel with the pivot link.

Also in the illustrative embodiment, the drive members that engage the support stand to move the hanger arm are coupled to the pivot link and extend therefrom. The drive members may comprise portions of a flexible element, such as a torsion spring. As the pivot link pivots about the pivot axis, free end regions of the drive members periodically come into contact with portions of the associated housing of the support stand to flex the drive elements and impart a force on the hanger arm. Illustratively, the contact portions of the housing are posts. To reduce noise, or "clicking" associated with drive member contact with the posts, the end portions of the drive members and the posts each have a soft sleeve mounted thereon.

The pivoting of the pivot link about the pivot axis is out of phase with the pivoting of the hanger arm and the seat about the pivot axis. Thus, the pivot link and hanger arm are sometimes pivoting in opposite directions about the pivot axis and are sometimes pivoting in the same direction about the pivot axis.

In some embodiments, the speed at which the motor rotates the output shaft is adjustable, thereby to adjust the frequency at which the drive members periodically engage the contact portions of the housing. In the illustrative embodiment, the motor is operable at three different speeds, although some embodiments contemplated by this disclosure may have greater, or fewer than three speeds. Thus, the frequency of oscillation of the hanger arm and the seat coupled thereto is sped up or slowed down by adjusting the speed of the motor. The hanger arm and seat naturally reach a resonant frequency depending upon the speed of the motor and the amount of weight being oscillated. In order to reach the resonant frequency of oscillation, the swing amplitude typically will change as the motor speed changes or as the amount of weight being oscillated changes.

Illustratively, the motor is controlled by electrical circuitry having a boost voltage capability to provide an increased voltage to start the swing oscillation under some circumstances. For example, when the swing is set for slow and medium speeds, a boost voltage which is higher than the normal operating voltages for the slow and medium speed settings is applied to the motor for a predetermined period of time at start up, such as for 30 seconds, so that the swing achieves the desired oscillation more quickly than if no boost voltage were applied. After the predetermined start-up period, the voltage applied to the motor is adjusted to the normal operating voltage for the speed setting. Additionally, motor suspension elements may comprise soft motor and axle supports to reduce noise transmitted between the motor and the mounting portion which carries the motor.

Additional features and advantages of motorized swing drives in accordance with the disclosure will become apparent to those skilled in the art upon consideration of the following detailed description of an illustrative embodiment exemplifying the best mode of carrying out a motorized swing drive as presently perceived.

BRIEF DESCRIPTION OF THE DRAWINGS

The detailed description particularly refers to the accompanying figures in which.

DETAILED DESCRIPTION OF THE DRAWINGS

Figure 1:
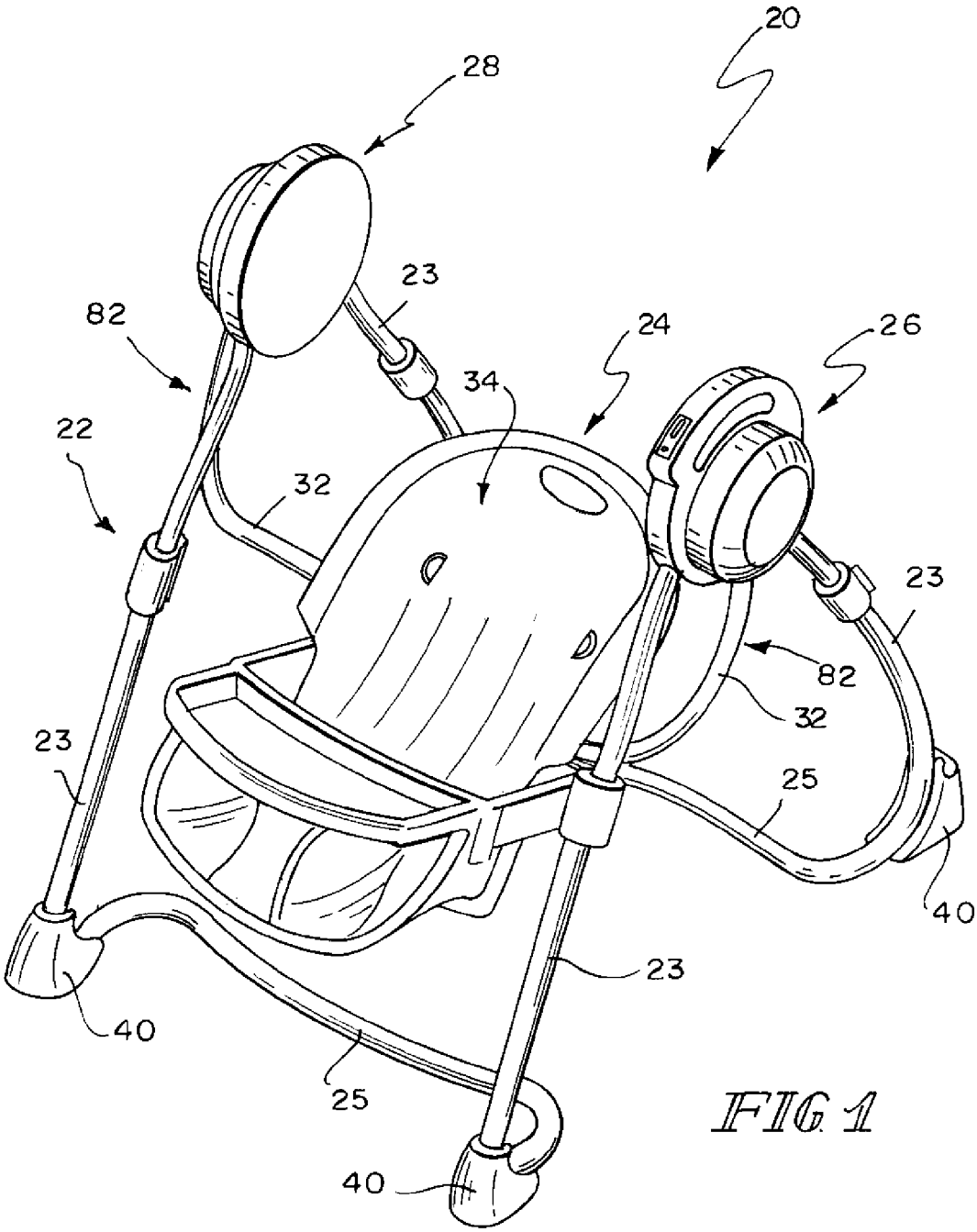
FIG. 1 is a perspective view of a juvenile swing apparatus in accordance with this disclosure showing a swing suspended with respect to a support stand and the swing comprising a seat and a pair of hanger arms.

A swing apparatus 20 comprises a support stand 22 and a swing 24 suspended for swinging movement with respect to stand 22 as shown in FIG. 1. Illustrative stand 22 comprises a set of main struts or frame members 23 and a set of cross struts or frame members 25. Stand 22 further comprises a first housing 26 coupled to upper end portions of two of struts 23 on one side of swing apparatus 20 and a second housing 28 coupled to upper end potions of another two struts 23 on the other side of swing apparatus 20 as shown in FIG. 1. Stand 22 comprises four floor-engaging feet 40 as shown in FIG. 1. Each foot 40 has coupled thereto the lower end of a respective main strut 23 and the end portions of cross struts 25. In some embodiments, stand 22 is foldable between an expanded use position, shown in FIG. 1, and a compact storage position (not shown). The configuration of stand 22 is illustrative and therefore, all types of stands capable of supporting swing 24 are within the scope of this disclosure.

Figure 2:
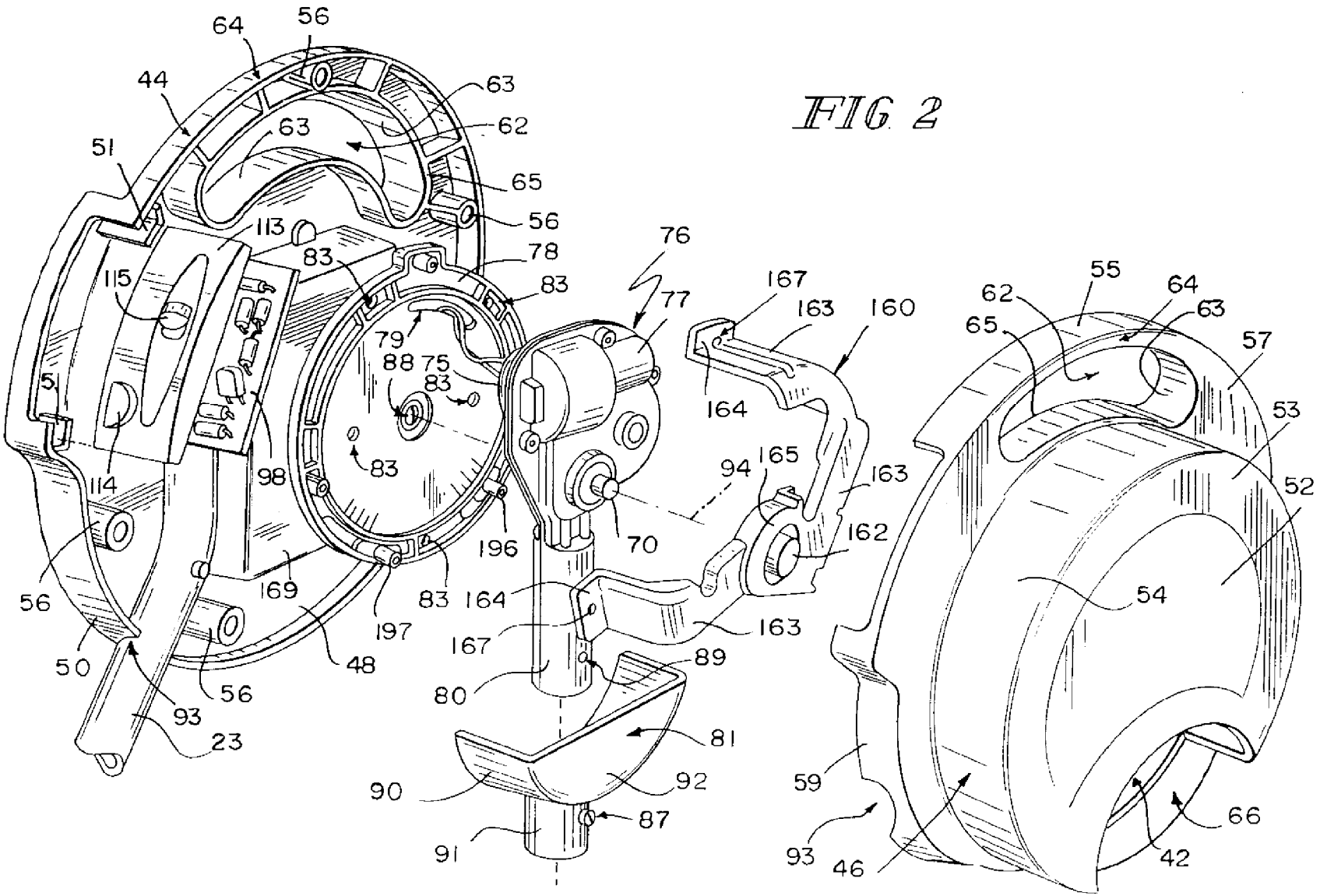
FIG. 2 is an exploded perspective view showing a first piece of a housing at an upper end of the support stand separated away from a second piece of the housing to expose components of a drive assembly situated in the housing.
Figure 3:
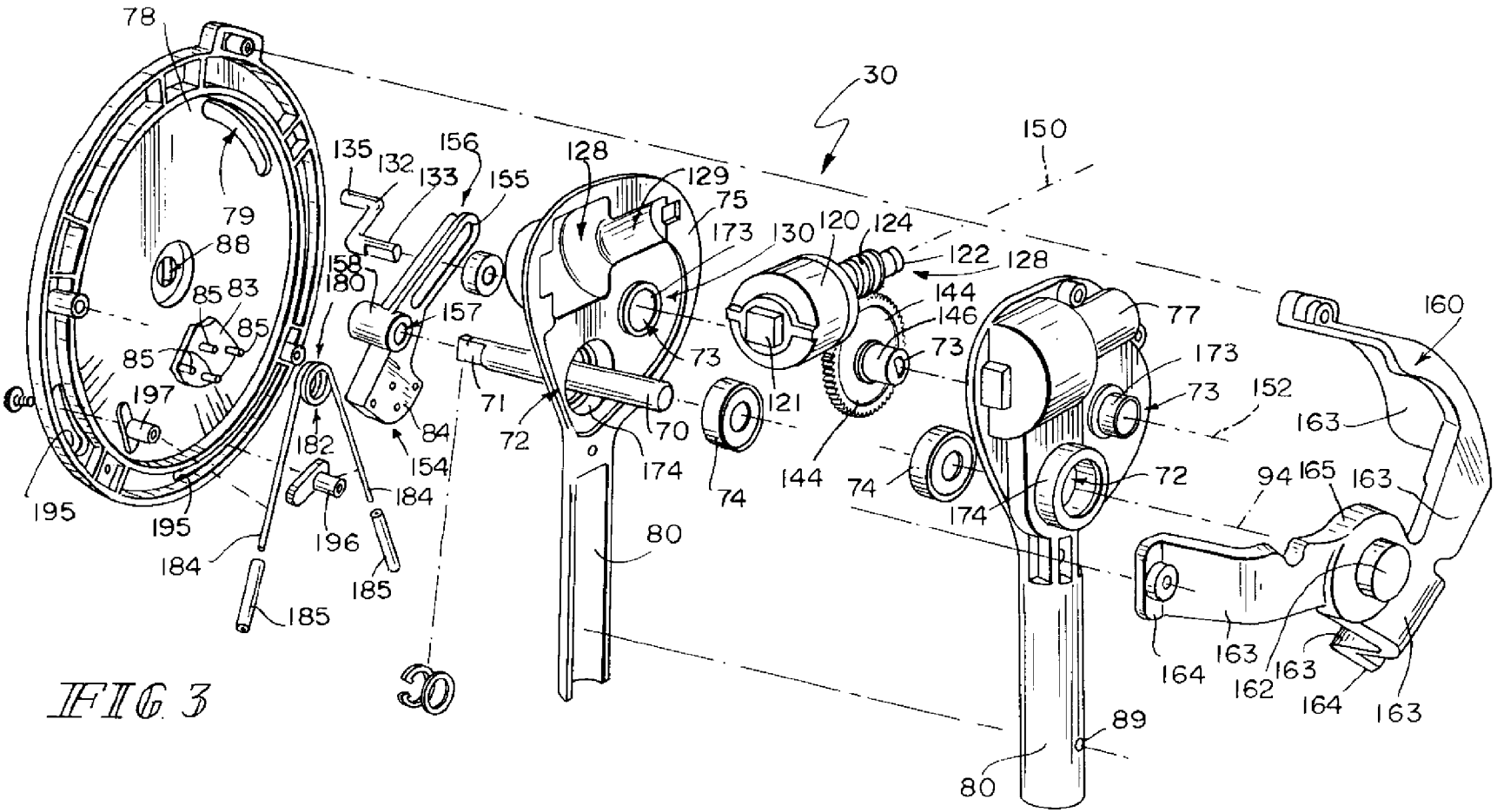
FIG. 3 is an exploded perspective view, with portions broken away, showing an upper end of one of the hanger arms separated away from a horizontal main shaft that extends from the second piece of the housing and showing the drive assembly including a motor that couples to a mounting portion of the hanger arm, a flywheel and worm mounted to an output shaft of the motor, a worm wheel meshed with the worm, a pivot link that couples to the main shaft for pivoting movement and that includes a connector link which interconnects the worm wheel and the pivot link, and a pair of flexible drive members that extend from the pivot link.
Figure 4:
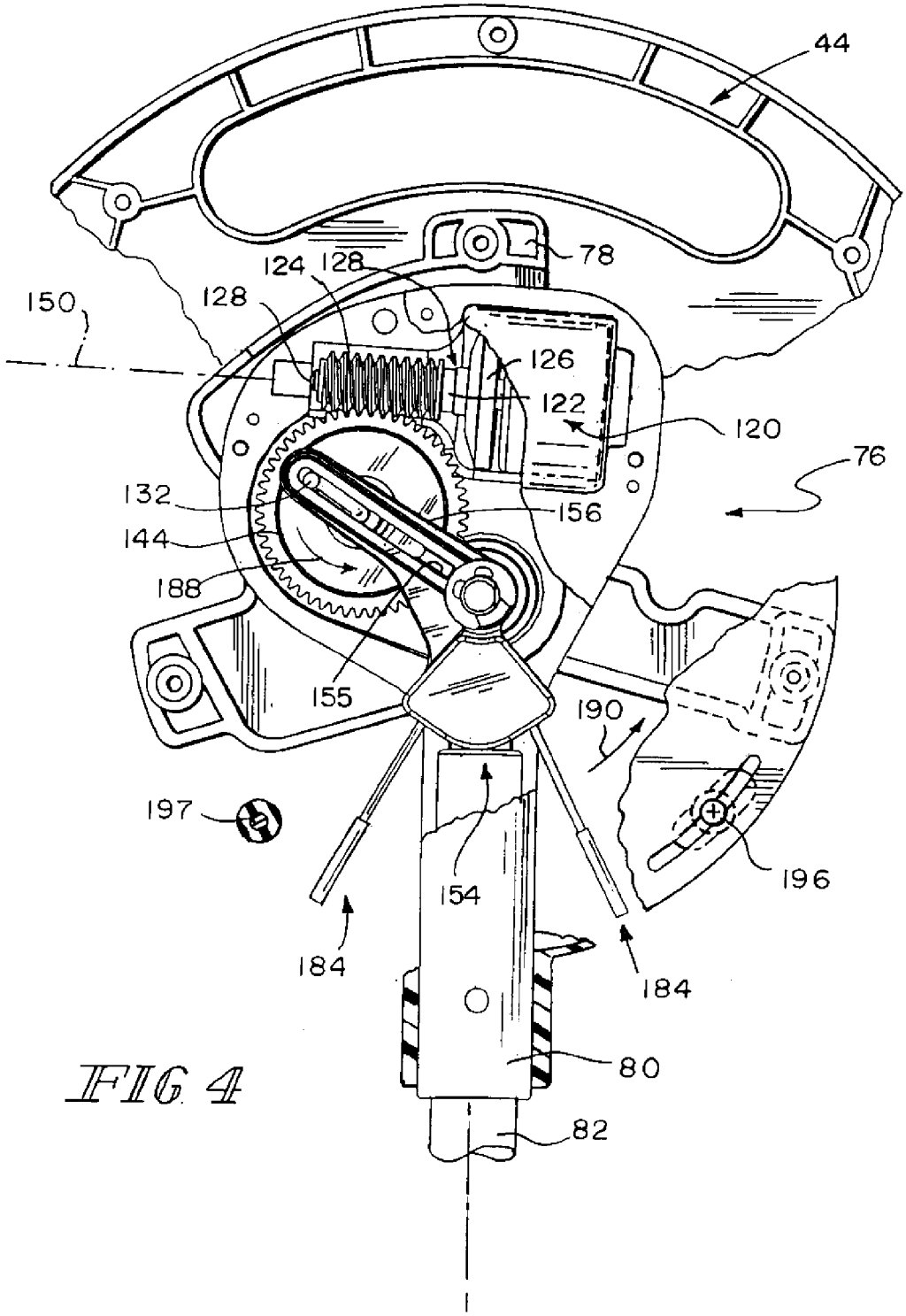
FIG. 4 is a side elevation view, with portions broken away, of an upper portion of the support stand, one of the hanger arms, and the drive assembly showing free end regions of the flexible drive member that are distal from the pivot link being spaced apart from stops that are appended to the housing and that are situated adjacent to an elongated portion which extends downwardly from the mounting portion and which receives a top portion of an associated hanger arm.
Figure 5:
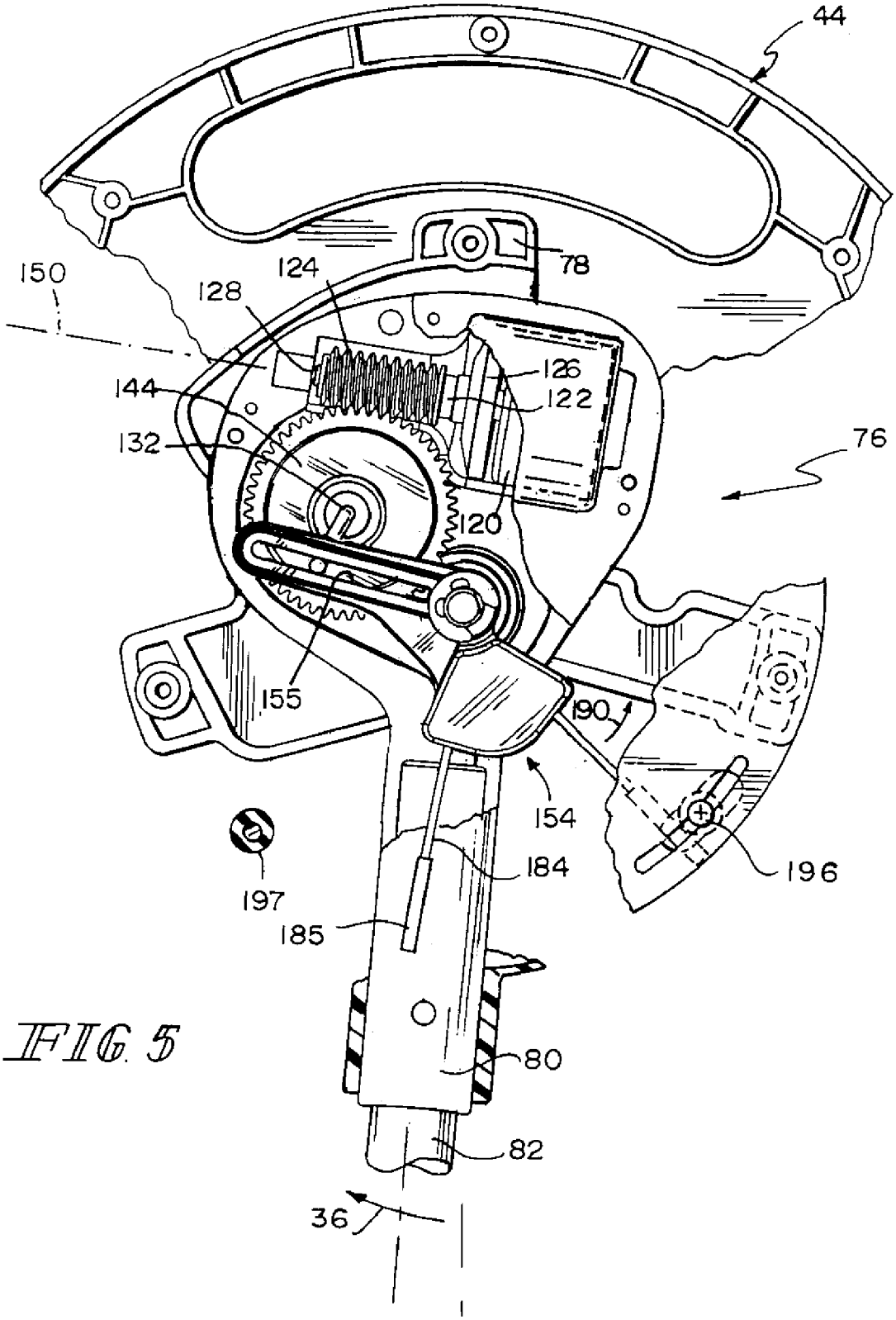
FIG. 5 is a side elevation view, with portions broken away, similar to FIG. 4, showing the drive assembly being operated to move the swing in a forward swing direction in response to a free end region of one of the flexible drive members contacting one of the stops appended to the housing which imparts a force on the hanger arm through the pivot link, the connector link and the worm wheel that tends to move the swing in the forward swing direction.

First housing 26 has an interior region 42 in which components of a drive assembly 30 of swing apparatus 20 are situated as shown in FIGS. 2-6. Apparatus 20 comprises a pair of hanger arms 32 and a seat 34 coupled to hanger arms 32. Seat 34 is configured to support an infant or toddler (not shown). One of hanger arms 32 is pivotably coupled to first housing 26 and the other of hanger arms 32 is pivotably coupled to second housing 28. When drive assembly 30 is turned off, swing 24 naturally comes to rest in a neutral position as shown in FIGS. 1 and 4. Operation of drive assembly 30 causes swing 24 to oscillate back and forth between forward and rearward extreme positions. Thus, during operation of drive assembly 30, swing 24 moves alternately in a forward swing direction, indicated by an arrow 36 shown in FIGS. 5 and 6 (arrow 36 is dashed in FIG. 6), and a back swing direction, indicated by an arrow 38 shown in FIG. 6.

Illustrative housing 26 comprises a first piece or shell 44 and a second piece or shell 46 as shown best in FIG. 2. Shell 44 has a generally vertical back wall 48 and a perimeter flange or wall 50 extending away from back wall 48 toward shell 46. Wall 50 blends smoothly with wall 48 such that a rounded edge is formed at the intersection of walls 48, 50. Shell 46 comprises a generally bowl-shaped first portion 52 having a generally vertical front wall 53 and a perimeter flange or wall 54 extending away from front wall 53 toward a second portion 55 of shell 46. Wall 54 blends smoothly with wall 53 such that a rounded edge is formed at the intersection of walls 53, 54. Second portion 55 has a generally vertical front wall 57 and a perimeter flange or wall 59 extending away from back wall 48 toward shell 44. The size and shape of housing 28 is substantially the same as the size and shape of housing 26. Housings 26, 28 may, however, be formed in any desired shape according to this disclosure. Furthermore, although illustrative housings 26, 28 are constructed from two pieces 44, 46, support stand 22 may include similar housings constructed from more than two pieces.

Illustrative shell 44 includes seven cylindrical bosses 56 that extend horizontally from back wall 48 into interior region 42 of housing 26. Shell 46 has small-diameter cylindrical bosses (not shown) that extend horizontally from front wall 57 into interior region 42 and that are aligned with bosses 56. Shell 46 further includes additional bosses (not shown) appended to wall 57 and shell 44 includes additional bosses (not shown) appended to wall 48. These additional bosses in shells 44, 46 receive opposite ends of respective pins 58 which extend through apertures 61 formed in the upper end regions of struts 23 as shown in FIG. 2 (only one pin 58 is shown in FIG. 2).

The strut 23 shown in FIG. 2 is a non-pivoting strut 23 and the upper end region of this strut 23 is coupled to shells 44, 46 by a pair of mounting pins 58 which extend through respective apertures 61 into the associated bosses. The other strut 23 is a pivoting strut 23 and has only one mounting pin 58 which extends through respective apertures 61 into the respective bosses. In the illustrative embodiment, struts 23 are tubular and therefore, there are two apertures 61 associated with each pin 58. If desired, struts 23 may be solid and such that each aperture extends through the solid material for receipt of an associated pin 58. The pivoting strut 23 pivots about the associated pin 58 during folding of stand 22 between the use and storage positions.

A set of fasteners (not shown), such as a set of bolts or screws, is provided for coupling shells 44, 46 together. The bolts are received by respective bosses 56 that extend from wall 48 and the companion small-diameter bosses that extend from wall 57 and are received into a distal end of bosses 56. The threaded end of the bolts are threaded into the bosses extending from wall 48 and bosses 56 have internal shoulders that are engaged by the respective distal ends of small-diameter bosses extending from wall 57. When shells 44, 46 are bolted together, struts 23 are retained between shells 44, 46 due to receipt of the ends of pins 58 in the associated bosses.

Walls 48 and 57 are each formed to include an arcuate hand-receiving slot portion 62 near an upper peripheral portion of walls 48, 57. Each shell includes a handle wall 63 that extends perpendicularly from the associated wall 48, 57 and that bounds the respective slot portion 62. When first housing 26 is coupled to second housing 28, end edges 65 of walls 63 abut, or are in very close proximity, such that slot portions 62 cooperate to provide a single hand-receiving slot 62 all the way through the associated housing 26, 28. Thus, part of walls 48, 50, 55, 57, 63 form a handle 64 above slot 62. Handles 64 are grippable by a user to move or carry swing apparatus 20 as desired.

Each housing 26, 28 includes a mounting portion 78 in the form of a round plate (sometimes referred to herein as "plate 78") as shown in FIGS. 2 and 3. Plate 78 has an arcuate wire-guide slot 79 at an upper peripheral region thereof and a D-shaped aperture 88 at the central region thereof. A pair of stops 196, 197 are coupled to a lower peripheral region of plate 78 and extend therefrom in a cantilevered manner as shown best in FIG. 2. In one embodiment, each of stops 196, 197 is cylindrical and is formed integrally with plate 78. Alternative stops may have shapes other than cylindrical and may comprise a separate element that is movable with respect to plate 78. Stops 196, 197 are considered to be part of support stand 22 in accordance with this disclosure. Plate 78 also has a set of mounting apertures 83 through which fasteners (not shown), such as screws, extend for receipt in respective screw-receiving bosses (not shown) provided in shell 44 to rigidly mount plate 78 to shell 44. When mounted to shell 44, plate 78 is substantially parallel with wall 48.

Swing 20 includes a drive assembly mount 76 situated in the interior region 42 of each housing 26, 28. The mount 76 associated with housing 26 carries drive assembly 30 as will be discussed in further detail below. Certain components of drive assembly 30 pivot with the associated mount 76 about a main swing pivot axis 94 during the oscillation of swing 24. A bottom portion of each mount 76 includes a socket 80 as shown in FIG. 2. Hanger arms 32 are each generally L-shaped and include a vertical portion 82 which, in turn, includes an upper end region which is received in a respective socket 80 and which is coupled to the respective socket 80 by a fastener, such as bolt. A generally horizontal lower portion of each arm 32 is coupled to seat 34 as shown in FIG. 1. Socket 80 and strut 82 are considered to be an elongated portion of hanger arm 32. In some alternative embodiments, arms 32 may have shapes other than the illustrative L-shape. Thus, arms 32 may be straight, arcuate, J-shaped, or any other desired shape.

The bottom portion of perimeter wall 54 has a fairly large notch 66 formed therein as shown in FIG. 2. The bottom portion of front wall 53 includes an extension of notch 66. Notch 66 in wall 53 cooperates with the notch in wall 54 to form a large opening through which socket 80 extends out of interior region 42 of housing 26 and within which one of hanger arms 32 swings back and forth during oscillation of swing 24 by drive assembly 30. Swing 20 includes a shroud 81 which has a tubular portion or sleeve 91, a semi-cylindrical wall portion 90, and a semi-circular wall 92 as shown in FIG. 2. Wall 90 blends smoothly with wall 92 such that a rounded semi-circular edge is formed at the intersection of walls 90, 92.

Sleeve 91 covers the lower end of socket 80 and is coupled thereto by the same bolt that couples the upper end of vertical portion 82 of arm 32 to socket 80. Thus, the bolt which couples arm 32, mount 78, and shroud 81 together extends through apertures 87 provided in sleeve 91, apertures 89 provided in socket 80, and apertures (not shown) provided in arm 32. In one embodiment, a nut is molded into sleeve 91 adjacent one of apertures 87 and receives a threaded end of the associated bolt which couples arm 32, mount 78, and shroud 81 together. Walls 90, 92 of shroud 81 are larger than notch 66 such that shroud 81 generally fills notch 66 and blocks access into interior region 42 while allowing socket 80 to oscillate within the confines of notch 66. Shroud 81 is configured to block unintended insertion of an infant's or care giver's fingers through notch 66 into interior region 42, for example.

Wall 50 of shell 44 and wall 59 of shell 46 each include a notch 93 and these notches cooperate to provide an opening through which the non-pivoting strut 23 extends into interior region 42. Walls 50, 59 also include larger notches (not shown) that cooperate to provide a large opening through which the pivoting strut 23 extends into interior region 42. The large opening formed by the larger notches allows the pivoting strut 23 to pivot relative to housing 26 between the use and storage positions.

Swing 20 includes a support bracket 160 which has a somewhat annular central region 165, a shaft-receiving boss 162 coupled to region 165, and a set of bracket arms 163 that extend from region 165. A first portion of each of arms 163 extends generally radially outwardly from central region 165 in parallel relation with plate 78 and a second portion of each of arms 163 extends toward plate 78 in perpendicular relation therewith. The distal ends of the second portions of arms 163 each have flanges 164 which are provided with apertures 167 through which fasteners, such as bolts, extend to couple bracket 160 to plate 78. Boss 162 extends slightly from central region 165 of bracket 160 and is received in a cylindrical boss (not shown) that extends from a central region of wall 82 into interior region 42 of housing 26.

Swing 20 includes a horizontal shaft 70, shown best in FIG. 3, having a D-shaped end 71 received in aperture 88 of plate 78 and an opposite end received in boss 162 of bracket 160. The portion of plate 78 having aperture 88 formed therein actually protrudes by a slight amount from the remainder of plate 78 and is received in a boss (not shown) provided in a back wall 169 of a battery compartment of shell 44. Thus, shaft 70 is supported at one end by both plate 78 and shell 44 and shaft 70 is supported at the opposite end by both boss 162 and shell 46. Accordingly, it will be appreciated that shaft 70 spans between shell 44 and shell 46 through interior region 42 of housing 26. Mount 76 is coupled to shaft 70 to oscillate about axis 94, which is defined by shaft 70. During oscillation of mount 76 and swing 24 about axis 94, shaft 70 does not rotate or oscillate due to the D-shape of end 71 and aperture 88.

Referring again to FIG. 2, drive assembly 30 has a circuit board 98 that carries various electric circuit components which serve as a controller for drive assembly 30. The circuitry carried by board 98 is operable to apply a motor-control voltage to an electric motor 120 of drive assembly 30 as will be discussed further below. A user input panel 113 carries an on/off button 115 which is coupled to the circuitry of board 98 and a speed select button 114 which is also coupled to the circuitry of board 98. Circuit board 98 is mounted to panel 113 which, in turn, is mounted to shell 46 by mounting brackets 51 formed in a portion of wall 50 of shell 44. Therefore, circuit board 98 does not pivot during oscillation of swing 24.

If on/off switch 115 is in the "on" position, then successive presses of button 114 by a user will turn drive assembly 30 on at a slow speed, then on at an intermediate speed, then on at a fast speed, and then off, sequentially. According to this disclosure the circuitry of board 98 applies a boot voltage to drive assembly 30 upon initial start up of the swinging motion of swing 24 as will be described in further detail below in connection with FIG. 7. In some 3-speed embodiments in which drive assembly 30 is operable as slow, intermediate, and high speeds, the boost voltage at start up corresponds to the voltage associated with the intermediate speed. In such an embodiment, if a low speed is selected by a user, pressing button 114 will apply the intermediate speed voltage to drive assembly for a predetermined period of time and then after a brief period will reduce the voltage to a level associated with the low speed.

Swings having more or less than three swinging speeds are contemplated by this disclosure as are swings in which the boost voltage at start up corresponds to the high speed voltage. Also when on/off switch 115 is in the "on" position, music which is stored in one or more memory devices of the circuitry of board 98 is turned on. In some embodiments, multiple songs may be stored in the memory devices of the swing circuitry and toggling of button 115 will scroll through the various songs. Circuit board 98, therefore, has a speaker (not shown) or similar sound-producing device through which the music is played. Of course, when button 115 is in the "off" position, no music is played and swing 24 does not oscillate.

Housing 28 and the hanger arm 32 associated with housing 28 are substantially the same, but mirror images of, housing 26 and the hanger arm 32 associated with housing 26. Thus, the description above of housing 26 and its associated hanger arm 32 is also applicable to housing 28 and its associated hanger arm 32 with a couple of notable exceptions. One notable exception is that no drive assembly is present in the interior region of housing 28. In addition, there is no circuit board with associated buttons coupled to housing 28.

Drive assembly 30 is situated in interior region 42 of housing 26 as mentioned above. Drive assembly 30 comprises a driver, which illustratively is an electric motor 120 having an output shaft 122. Drive assembly 30 also has a worm 124 mounted on an end of output shaft 122 and a flywheel 126 mounted on output shaft 122 between worm 124 and the main portion of motor 120 as shown in FIGS. 3-6.

Drive assembly mount 76 includes a first portion 75 and a second portion 77 as shown in FIG. 3. Each of portions 75, 77 of mount 76 comprise a bearing-receiving boss 174 which is formed to include a main shaft-receiving aperture 72 and an axle-receiving boss 173 which is formed to include a worm wheel axle-receiving aperture 73. Each of the two portions 75, 77 of mount 76 are also formed to include a motor-receiving recess 128, a worm-receiving recess 129, and a worm wheel-receiving recess 130 as shown in FIG. 3. Motor 120 is held in position in mount 76 when portion 75 is coupled to portion 77 by suitable fasteners. Bearings 74 are situated within respective bosses 74 to support mount 76, arm 32, and seat 24 for oscillation on shaft 70.

A set of wires 99 extends between circuit board 98 and motor 120 with enough slack to permit oscillation of motor 120 about axis 94 along with mount 76, as shown best in FIG. 2. Wires 99 pass through slot 79 in plate 78 and slot 79 is sufficiently long to accommodate the movement of wires 99 as swing 24 oscillates. Power to operate motor 120 at the selected speed is applied to motor 120 via wires 99. A suitable power source, such as a set of batteries 103 (four D-cell batteries, for example) is situated in the battery compartment adjacent to wall 169 of shell 44. Power from the batteries 103 is used to operate motor 120. Circuit board 98 has appropriate circuitry for controlling the voltage applied to motor 120 from batteries 103 as mentioned above and as will be described in further detail below. Thus, the speed at which motor 120 operates is adjusted by adjusting the voltage applied to motor 120.

Drive assembly 30 further comprises a worm wheel 144 which includes a pair of pivot axles 146 that are sized for receipt in apertures 74 of respective bosses 173. Pivot axles 146 of worm wheel 144 are formed to include a D-shaped central aperture 73 that receives a D-shaped end segment 133 of a crank-shaped connector link 132. Connector link 132 extends from central aperture 73 formed in pivot axles 146 and into a slot 155 formed in a pivot link 154. Worm wheel 144 is meshed with worm 124 so that rotation of worm 124 about an axis 150 that is perpendicular to axis 94 results in rotation of worm wheel 144 about a wheel axis 152 that is parallel with axis 94.

Pivot link 154 includes a shaft-mounting portion 158, a connector arm 156 extending radially outwardly from portion 158, and a first drive member mounting portion 84 extending downwardly from portion 158 as shown in FIG. 3. Portion 158 has a shaft-receiving bore 157 through which shaft 70 extends. Link 154 also includes a second drive member mounting portion 83. Portion 83 includes a set of horizontal posts 85 that extend toward portion 84 in a cantilevered manner.

Drive assembly 30 further includes a drive element 180, which in the illustrative embodiment comprises a torsion spring having an upper, coiled region 182 and a pair of elongate drive members 184 extending generally downwardly from region 182, the pair of elongate drive members 184 forming an acute angle relative to one another (see FIG. 3). Portion 83 is coupled to portion 84 such that the coiled region 182 of element is trapped between portions 83, 84 and retained by posts 85. Thus, element 180 is coupled to link 154 to oscillate therewith about pivot axis 94. Illustratively, connector arm 156 is elongate and is formed to include a slot 155. Slot 155 receives an orbiting segment 135 of link 132 therein. As worm wheel 144 rotates about axis 152, segment 135 of link 132 orbits about axis 152 which causes pivot link 154 and element 180 to oscillate about axis 94, which is the same axis 94 about which swing 24 oscillates. However, link 154 oscillates about axis 94 independent from the oscillation of swing 24 about axis 94 such that link 154 and swing 24 may oscillate out of phase.

In the illustrative embodiment, drive element 180 is flexible and comprises a torsion spring which has a pair of generally straight leg portions which serve as drive members 184. In alternative embodiments, other types of drive members, such as one or more leaf springs, zigzag springs, or spring-loaded rigid members, may be provided in drive assembly 30 in lieu of illustrative torsion spring so long as these alternative drive members have suitable spring constants and/or flexing characteristics for moving swing 24 in a desired manner. Operation of motor 120 causes drive element 180 to oscillate about axis 94 through a drive train of assembly 30, which drive train is provided by worm 124, worm wheel 144, connector arm 156, and pivot link 154.

When drive assembly 30 is turned off and swing 24 is in the neutral position, drive assembly 30 may be in an arbitrary stationary position such as the one shown in FIG. 4 in which drive members 184 of drive element 180 are spaced apart from stops 196, 197. When drive assembly 30 is turned on, motor 120 rotates worm 124 about axis 150 which, in turn, causes worm wheel 144 to rotate about axis 152 in a counterclockwise direction indicated by arrow 188 in FIG. 4. In the illustrative example, as worm wheel 144 rotates in direction 188, connector arm 156 pushes pivot link 154 to rotate pivot link 154 in a counterclockwise direction indicated by arrow 190 in FIGS. 4 and 5. As pivot link 154 rotates about axis 94 in direction 190, one of drive members 184 of element 180 eventually engages stop 196 causing element 180 to flex.

As element 180 flexes due to engagement with stop 196, a force is imparted on pivot link 154 by member 180 to counteract or retard the pivoting movement of link 154, thereby to counteract or retard the ability of connector arm 156 to move pivot link 154 which, in tum, attempts to counteract or retard the ability of worm wheel 144 to move connector arm 156. However, worm wheel 144 is meshed with worm 124 which is being rotated by motor 120 at a predetermined speed as dictated by the speed setting of motor 120 selected by the user. Thus, the force imparted on worm wheel 144 by drive element 180, through links 154, 156, is transmitted to mount 76 of hanger arm 32 through connector link 132 which causes swing 24 to pivot about axis 94 in forward swing direction 36, as shown best in FIG. 5.

While drive member 180 is flexed due to contact with stop 196, a driving force is imparted by member 180 on hanger arm 32 via the drive train of drive assembly 30 to move swing 24 in forward swing direction 36. As worm wheel 144 continues to rotate in direction 188 from the position shown in FIG. 5, connector link 132 acts upon pivot link 154 to reverse the direction of motion of pivot link 154 such that pivot link 154 stops pivoting about axis 94 in direction 190, but instead pivots about axis 94 in a clockwise direction indicated by arrow 194 shown in FIG. 6. As pivot link 154 pivots about axis 94 in direction 194, the amount of flexure of drive member 180 first decreases and then drive member 180 separates away from stop 196.

Figure 6:
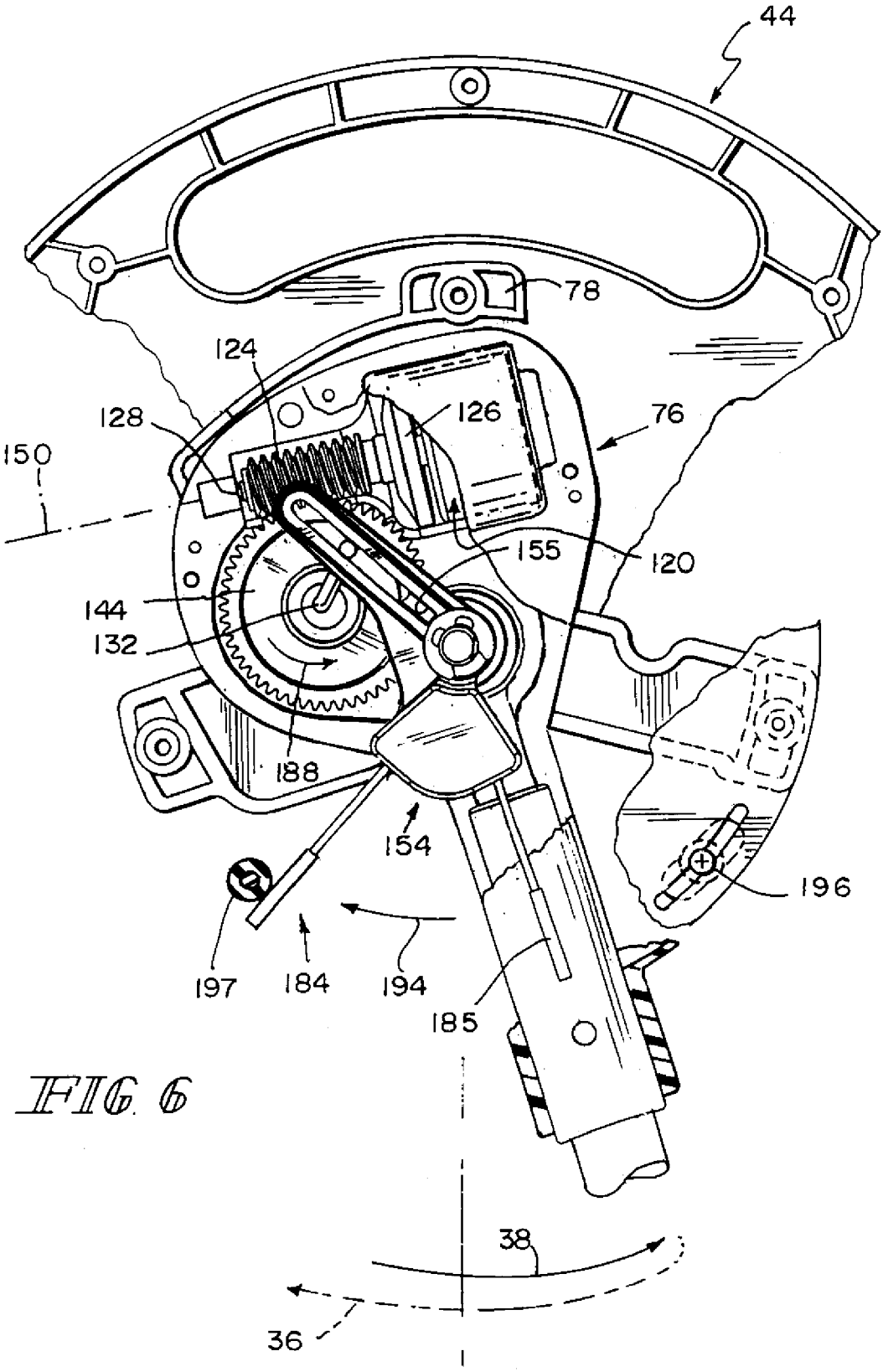
FIG. 6 is a side elevation view, with portions broken away, similar to FIG. 5, showing the drive assembly being further operated to move the swing in a rearward swing direction so that the free end region of the other of the flexible drive members contacts the other one of the stops appended to the housing which imparts a force on the hanger arm through the pivot link, the connector link and the worm wheel which tends to move the swing in a rearward swing direction.

As worm wheel 144 continues to rotate about axis 152 in a counterclockwise direction indicated by arrow 188 and pivot link 154 moves about axis 94 in direction 194, the other of drive members 184 of drive element 180 eventually engages stop 197 as shown in FIG. 6, causing element 180 to flex. As element 180 flexes due to engagement with stop 197, a force is imparted on pivot link 154 by member 180 to counteract or retard the pivoting movement of link 154, thereby to counteract or retard the ability of connector arm 156 to move pivot link 154 which, in turn, attempts to counteract or retard the ability of worm wheel 144 to move connector arm 156. However, worm wheel 144 is meshed with worm 124 which is being rotated by motor 120 at a predetermined speed as dictated by the speed setting of motor 120 selected by the user. Thus, the force imparted on worm wheel 144 by drive member 180, through links 154, 156, is transmitted to mount 76 of hanger arm 32 through connector link 132 which causes swing 24 to pivot about axis 94 in rearward swing direction 38, as shown best in FIG. 6.

Depending upon the weight of swing 24, the load carried by swing 24, and the duration and magnitude of the force imparted on swing 24 by drive members 184 of element 180, swing 24 will move in forward swing direction 36 by some certain angular displacement (up to the maximum angular displacement determined by sleeves 91 contacting housings 26, 28 at one end of notches 66) and then swing 24 will start swinging in back swing direction 38. Swing 24 will move in back swing direction 38 by some certain angular displacement (up to the maximum angular displacement determined by sleeves 91 contacting housings 26, 28 at the other end of notches 66) and then, at some point during motion of swing 24 in direction 38, one of drive members 184 of element 180 will, once again, contact stop 196 to impart a force on swing 24 to push swing 24 in forward swing direction 36.

In the illustrative embodiment, motor 120 is operable at three different speeds as mentioned above. The frequency of oscillation of hanger arm 32 and seat 34 is sped up or slowed down by adjusting the speed of motor 120. It has been found that swing 24 naturally tends toward a resonant frequency depending upon the speed of motor 120 and other factors, such as the amount of weight being oscillated. In order to reach the resonant frequency of oscillation, the swing amplitude (i.e., the extent of angular movement of swing 24 measured from the first extreme position to the second extreme position) typically will change as the motor speed changes or as the amount of weight being oscillated changes.

If for some reason, swing 24 is prevented from swinging in either forward swing direction 36 or back swing direction 38 or both, drive assembly 30 is still able to operate as usual having drive members 184 periodically engaging stops 196, 197 and flexing to impart a force on swing 24 with no resulting movement of swing 24. Thus, the flexibility of drive element 180 provides drive assembly 30 with a lost motion connection so that no components of apparatus 20 are damaged if swing 24 is unable to oscillate about axis 94.

Based on the foregoing discussion, it should be understood that drive assembly 30 is coupled to hanger arm 32 to pivot therewith about axis 94, which is the same axis that hanger arm 32 and seat 24 pivot about relative to stand 22. Thus, the weight of drive assembly 30 contributes to the overall inertia of the swinging mass which enhances the smoothness of swinging motion because the occupant of seat 24 will be less likely to "feel" the contact and release of drive members 184 from stops 196, 197. In addition, the drive assembly 30 is self-starting in that a user does not need to push swing 24 to start the swinging motion of swing 24. The self-starting torque is generated by motor 120. When a user presses button 114 once, for example, to turn the motor on to the lowest speed, a voltage boost feature momentarily increases the voltage of the motor to the medium speed to begin the swing oscillation, and then, after a brief period, reduces the voltage once again to the lowest speed. In addition, apparatus 20 has been found to be quieter in operation than some other swings which have motors fixed relative to the associated stands. This is believed to be due to motor vibrations being dissipated or attenuated through the use of motor mounts and worm axle supports made of soft materials of between 60-85 shore. Illustratively, motor support 121 is constructed of KRATON®isoprene rubber, but may be constructed of any other material having suitable elasticity and durability. Worm axle supports 128 are illustratively constructed of GLS VERSAFLEX® rubberized thermoplastic urethane, but may be constructed of other materials having suitable durability and elasticity such as thermoplastic elastomers.

Additionally, torsion spring end portions 184 form an acute angle relative to one another and have soft sleeves 185 mounted thereto (see FIG. 3). Soft sleeves 185 are made of KRATON® isoprene rubber in some embodiments, but may be constructed from any material having suitable elasticity and durability. Stops 196, 197 may also be covered with soft materials, or in some embodiments made of soft materials, such as KRATON® isoprene rubber or other types of materials of suitable elasticity and durability. Thus, when sleeves 185 contact stops 196, 197, noise is reduced because both elements are made of soft materials.

Figure 7:
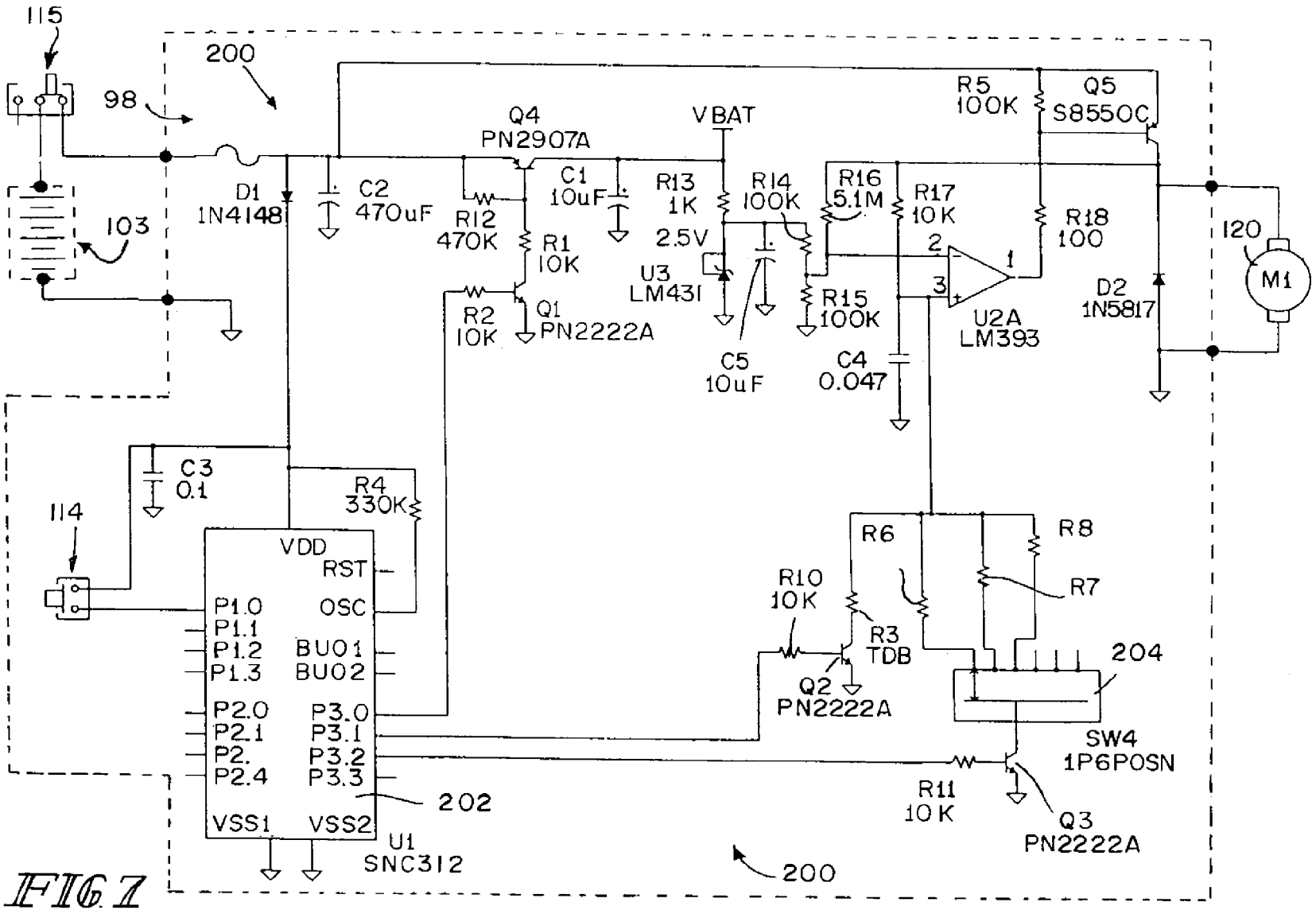
FIG. 7 is a schematic view showing electrical circuitry associated with controlling the motor speed of the juvenile swing apparatus.

Referring now to FIG. 7, motor control circuitry 200 on circuit board 98 includes a controller 202 and a multi-position switch 204. While circuit 200 may include any suitable logic-based controller, such as a microcontroller, microprocessor, programmable gate array, and the like, illustrative controller 202 comprises a model no. SNC312 direct drive voice/dual tone melody controller available from Sonix Technology Co., Ltd. of Springfield, Va. Controller 202 is coupled to buttons 114, 115 as shown in FIG. 7. Illustrative switch 204 is an electrically controlled 6-position switch. The position of switch 204 is controlled by controller 202 via pin 3.2. Controller 202 changes an output voltage of pin 3.2 to turn a transistor Q3 on and off through an associated 10 kilo Ohm (kΩ) resistor R11.

Resistors R6, R7, and R8 are coupled to respective pins of switch 204 and to the non-inverting input terminal of an operational amplifier U2A. In the illustrative example, switch 204 has six possible positions, but only three of the positions have resistors associated therewith because circuit 200 is configured to establish three normal operating speeds for motor 120. Thus, in the illustrative example, three positions of switch 204 are not used. In other embodiments, circuit 200 may be configured to establish up to six normal operating speeds for motor 120 by coupling the pins associated with the unused switch positions of switch 204 with the non-inverting input of amplifier U2A through associated resistors. Of course, circuit 200 may also be configured to establish less than three normal operating speeds for motor 120, if desired. Switch 204 may be replaced by one or more other switches which alone or in combination have more than six positions to establish more than six normal operating speeds for motor 120, if desired.

The operating speed of the motor is determined by the voltage applied to the motor. As discussed above, batteries 103 supply power to operate motor 120. Batteries 103 are coupled to motor 120 through button 115 and a number of circuit elements shown in FIG. 7 but which will not be described herein for the sake of brevity. The circuit schematic of FIG. 7 will be understood by those skilled in the art. As also discussed above, a boost voltage is applied to motor 120 at start up to facilitate swing 24 reaching its normal oscillation frequency more quickly. To apply the boost voltage to motor 120, controller 202 changes an output voltage of pin 3.1 to turn a transistor Q2 from an off state to an on state through an associated 10 kΩ resistor R10. Controller 202 turns off transistor Q3 while transistor Q2 is turned on to apply the boost voltage. Transistor Q2 is coupled to the non-inverting input of amplifier U2A through a resistor R3.

The values of resistors R3, R6, R7, and R8 are selected to establish the voltage applied to motor 120 in accordance with the formula $Rx=10k\Omega/((Vm/1.25)-1)$, where Rx=R3, R6, R7, or R8, as the case may be, and Vm=the desired voltage to be applied to the motor. Thus, the values of R3, R6, R7, R8 are at the discretion of the circuit designer. By way of example, if the desired boost voltage is 2.95 Volts (V), the desired motor voltage for slow speed is 2.7 V, the desired motor voltage for intermediate speed is 2.85 V, and the desired motor speed for high speed is 2.95 V, then R3=13.6 kΩ, R6=11.6 kΩ, R7=12.8 kΩ, and R8=13.6 kΩ.

Although the motorized drive for juvenile swing has been described in detail with reference to certain illustrative embodiments, variations and modifications exist within the scope and spirit of the disclosure as described and as defined in the following claims.

The invention claimed is:

1. A swing apparatus comprising a support stand, a swing supported with respect to the support stand to oscillate back and forth along a swing arc about a pivot axis, the swing having a seat and a hanger arm, and a drive assembly having a driver mounted to the hanger arm to oscillate therewith, the drive assembly having a pair of drive members that form an acute angle relative to one another, the drive members being driven by the driver and periodically engaging respective first and second portions of the support stand resulting in forces being imparted on the hanger arm to oscillate the swing back and forth.

2. The swing apparatus of claim 1, wherein the drive members are flexible.

3. The swing apparatus of claim 1, wherein the drive members comprise leg portions of a torsion spring.

4. The swing apparatus of claim 1, wherein the drive members also oscillate about the pivot axis.

5. The swing apparatus of claim 1, wherein the driver comprises an electric motor that is coupled to the hanger arm to oscillate therewith about the pivot axis.

6. The swing apparatus of claim 5, wherein the electric motor has an output shaft and the drive assembly further comprises a worm mounted to the output shaft, a worm wheel meshed with the worm and coupled to the hanger arm to rotate about a wheel axis that is spaced from the pivot axis, a pivot link to which the drive member is coupled, and a connector that interconnects the worm wheel and the pivot link.

7. The swing apparatus of claim 6, wherein the wheel axis is parallel with the pivot axis.

8. The swing apparatus of claim 5, further comprising an electric circuit that operates to apply a boost voltage to the electric motor to start the swing oscillation at start up, the boost voltage being applied for a predetermined period of time after which a lower voltage is applied to the electric motor.

9. The swing apparatus of claim 1, wherein at least one of a portion of the drive members and the first and second portions of the support stand that the drive members periodically engage includes a soft sleeve.

10. The swing apparatus of claim 1, wherein the support stand comprises a housing and a set of frame members extending from the housing and the first and second portions of the support stand that are periodically engaged by the drive members each comprise a stop appended to the housing.

11. The swing apparatus of claim 1, wherein the hanger arm comprises a first mounting portion to which the drive assembly is coupled, an elongated second mounting portion extending from the first mounting portion, and a strut extending between the elongated second mounting portion and the seat.

12. A swing apparatus comprising a support stand including a stationary plate, a seat, a hanger arm having a mounting portion that is coupled to the support stand, the hanger arm having an elongated portion extending between the mounting portion and the seat, the hanger arm and seat being movable together about a pivot axis, and a drive assembly having a driver mounted to the mounting portion to pivot therewith about the pivot axis, a drive member that engages the stationary plate resulting in a force being imparted on the hanger arm to oscillate the hanger arm and the seat about the pivot axis, and a drive train interconnecting the driver and the drive member, the drive train comprising a pivot element that oscillates about the pivot axis, the drive member being coupled to and extending from the pivot element to oscillate therewith.

13. The swing apparatus of claim 12, wherein the drive member comprises a torsion spring.

14. The swing apparatus of claim 13, wherein the torsion spring has two leg portions an further comprising a soft sleeve covering on each leg portion.

15. The swing apparatus of claim 12, wherein the portion of the support stand engaged by the drive member comprises a post.

16. The swing apparatus of claim 15, further comprising a sleeve that is coupled to the post and that is made of a soft material to reduce noise when the drive member engages the post.

17. The swing apparatus of claim 12, wherein the support stand comprises a housing and a set of frame members extending from the housing and the portion of the support stand that is periodically engaged by the drive member comprises a stop appended to the housing.

18. The swing apparatus of claim 12, wherein the speed at which the driver is operable is adjustable to adjust a frequency at which the hanger arm and seat oscillate.

19. The swing apparatus of claim 12, wherein the driver comprises an electric motor and the drive train further comprises a worm that is rotated by the electric motor, a worm wheel meshed with the worm and coupled to the hanger arm to rotate about a wheel axis that is spaced from the pivot axis, and a connector that interconnects the worm wheel and the pivot element.

20. The swing apparatus of claim 19, further comprising a motor support and an axle support to mount the electric motor and the worm, respectively, to the mounting portion, the motor support and the axle support each being made of a vibration dampening material.

21. The swing apparatus of claim 12, wherein the elongated portion of the hanger arm comprises a socket appended to the mounting portion and a strut having a first end portion received in the socket and a second end portion coupled to the seat.

22. The swing apparatus of claim 21, wherein the mounting portion substantially encases both the driver and a portion of the drive train.

23. A swing apparatus comprising a support stand, a swing supported with respect to the support stand to oscillate back and forth along a swing arc about a pivot axis, and means for driving the swing to oscillate about the pivot axis, at least a portion of the driving means being coupled to the swing and pivoting with the swing about the pivot axis, and the driving means including a drive element having a pair of distal end regions forming an acute angle relative to one another, and the drive element periodically engages the support stand to oscillate the swing about the pivot axis.

24. The swing apparatus of claim 23, wherein the drive element comprises a torsion spring.

25. The swing apparatus of claim 23, wherein the driving means has a pivot element that oscillates about the pivot axis out of phase with the swing, the drive element has a proximal end region coupled to the pivot element, and the pair of distal end regions are spaced from the pivot element and periodically engage portions of the support stand to oscillate the swing.

26. A swing apparatus comprising a support stand including a stationary plate, a seat, a hanger arm having a mounting portion that is coupled to the support stand, the hanger arm having an elongated portion extending between the mounting portion and the seat, the hanger arm and seat being movable together about a pivot axis, and a drive assembly having a motor mounted to the mounting portion to pivot therewith about the pivot axis, a torsion spring that engages posts appended to the stationary plate resulting in a force being imparted on the hanger arm to oscillate the hanger arm and the seat about the pivot axis, and a drive train interconnecting the motor and the torsion spring, the drive train comprising a pivot element that oscillates about the pivot axis, the torsion spring being coupled to and extending from the pivot element.

27. The swing apparatus of claim 26, wherein the torsion spring has two leg portions.

28. The swing apparatus of claim 27, wherein the leg portions include an end portion covered by a soft material.

29. The swing apparatus of claim 26, wherein the posts are made of a soft material.

30. The swing apparatus of claim 26, wherein the motor has an output shaft and the drive assembly further comprises a worm mounted to the output shaft, a worm wheel meshed with the worm and coupled to the hanger arm to rotate about a wheel axis that is spaced from the pivot axis, a pivot link to which the drive member is coupled, and a connector that interconnects the worm wheel and the pivot link.

31. The swing apparatus of claim 30, wherein the motor is mounted to the mounting portion by motor and worm axle supports that are made of a material having a durometer from about 60 shore to about 85 shore.

* * * * *